US005560088A

United States Patent [19]

Nitsche et al.

[11] Patent Number: 5,560,088

[45] Date of Patent: Oct. 1, 1996

[54] COUPLING PIECES FOR CONNECTING CONTAINERS

[75] Inventors: Torsten M. Nitsche, Bremen; Julius Donner, Barschlüte, both of Germany

[73] Assignee: Conver-OSROzean-Service-Reparatur-Ingenieurtechnik GmbH, Germany

[21] Appl. No.: 119,810

[22] Filed: Sep. 10, 1993

Related U.S. Application Data

[63] Continuation of Ser. No. 764,892, Sep. 24, 1991, abandoned.

[30] Foreign Application Priority Data

Sep. 25, 1990 [DE] Germany ..... 40 30 336.5

[51] Int. Cl.[6] ..... B65D 21/032

[52] U.S. Cl. ..... 24/287

[58] Field of Search ..... 24/287, 573.1, 24/573.5; 410/73–80

[56] References Cited

U.S. PATENT DOCUMENTS

| | | | |
|---|---|---|---|
| 2,411,900 | 12/1946 | Seward . | |
| 2,972,175 | 2/1961 | Abolins . | |
| 3,718,218 | 2/1973 | Shields . | |
| 3,722,714 | 3/1973 | Morris et al. . | |
| 3,734,442 | 5/1973 | Lunde . | |
| 3,894,493 | 7/1975 | Strecker . | |
| 3,973,684 | 8/1976 | DiMartino | 410/79 X |
| 4,212,251 | 7/1980 | DiMartino . | |
| 4,277,212 | 7/1981 | Rosaia . | |
| 4,564,984 | 1/1986 | Takaguchi . | |
| 4,626,155 | 12/1986 | Hlinsky et al. . | |
| 4,782,561 | 11/1988 | Hayama . | |
| 5,062,752 | 11/1991 | Takaguchi | 24/287 X |

FOREIGN PATENT DOCUMENTS

| | | | |
|---|---|---|---|
| 268415 | 11/1987 | European Pat. Off. . | |
| 2153933 | 5/1973 | Germany . | |
| 2902058 | 7/1973 | Germany . | |
| 7528229 | 9/1978 | Germany . | |
| 3234613 | 4/1983 | Germany . | |
| 8311706.7 | 7/1983 | Germany . | |
| 3220743 | 12/1983 | Germany . | |
| 2734750 | 8/1985 | Germany . | |
| 3538892 | 5/1988 | Germany . | |
| 3642399 | 6/1988 | Germany . | |
| 3710419 | 10/1988 | Germany . | |
| 3809834 | 11/1988 | Germany . | |
| 59-23743 | 2/1984 | Japan | 410/82 |
| 8800132 | 9/1988 | Sweden . | |
| 2056412 | 3/1981 | United Kingdom . | |

OTHER PUBLICATIONS

Dipl.–Ing. J. Gloystein and Prof. Dr.–Ing. E. Lehmann, *Stauung von Containern im Laderaum von Massengutschiffen*, HANSA–Schiffahrt–schiffbauhafen, 125 Jg., Sep. 1988 Nr. 17/18, S. 942–946.

Von Wolfram Blasius, *Containertransport mit dem Binnenschiff auf dem Rhein*, Transport Forder–und Lagertechnik, Mai 1988 H. 5, S. 31,34 bis 37.

*Steel Castings for Container Construction and Transportation*, English Steel Casting Corporation, Ltd. 1971.

*Primary Examiner*—James R. Brittain

*Attorney, Agent, or Firm*—Cook, McFarron & Manzo, Ltd.

[57] ABSTRACT

A coupling piece includes an abutment and locking member which is shiftable relative to the abutment to allow for an automatic and reliable locking of the containers. The coupling pieces do not jam when the connection is released by means of slightly tilting the upper container. The coupling piece is particularly suitable for automatically locking and releasing tightly stowed containers, especially 20' containers. In an alternate embodiment, a coupling piece is shaped such that the entire coupling piece is shifted to a locking position when containers are placed on top of one another.

7 Claims, 14 Drawing Sheets

COUPLING PIECES FOR CONNECTING CONTAINERS

This is a continuation of application Ser. No. 07/764,892, filed on Sep. 24, 1991, abandoned.

BACKGROUND OF THE INVENTION

The invention relates to a coupling piece for connecting containers on board of ships, including an abutment located essentially between the containers to be connected and coupling projections arranged on opposed sides of the abutment which are each provided for engaging one corner fitting of the containers to be connected.

The coupling pieces (so-called twistlocks) which are usually used on board of ships to connect containers have to be released by hand. Since especially small 20' containers are stowed very tightly, the coupling pieces are released (and possibly also locked) by persons standing on the containers with bar-like tools which are inserted into the gaps between adjacent containers. New safety regulations have put an end to this practice and it is no longer possible to release (and if required to lock) the coupling pieces by persons standing on top of the containers.

Although there are prior art coupling pieces of the aforementioned type which take the foregoing into account, they only provide an insufficient connection.

SUMMARY OF THE INVENTION

Setting out from this problem, the invention is based on the object to provide a self-locking and self-releasing coupling piece for reliably connecting containers.

To attain this object, the coupling piece as taught by the invention is characterized in that at least one coupling projection of the coupling piece is designed such that it is movable into at least one locking position relative to the corner fitting of the associated container by means of a relative displacement. As a result, the coupling projection can be provided with a distinct anchoring lug which, in its locking position, enters the corner fitting of the respective container thus far that it establishes a sufficient positive connection thereto.

Expediently, the relative displacement of at least one coupling projection or of the whole coupling piece is conducted transverse to the connecting direction of the containers which are to be coupled together, i.e. in the horizontal direction. Thus, the containers are connected in the more important vertical direction, i.e. they are secured against being lifted off. When two containers are connected with four corner fittings, the containers can be secured against a horizontal displacement by means of using two customary horizontally and vertically locking twist-locks and two exclusively vertically locking coupling pieces as taught by the invention.

An essential feature of the invention is to assign at least one displacement means to preferably the lower coupling projection. This displacement means ensures that at least the coupling projection, but preferably the whole coupling piece, can be shifted relative to the corner fittings to connect the containers. Expediently, the displacement means is formed on a coupling projection by an inclined or concavely curved glide face.

According to a preferred embodiment of the invention, at least one coupling projection can be displaced relative to the abutment located between the containers. Expediently, both coupling projections projecting on opposed sides of the abutment are simultaneously (horizontally) shiftable relative to the abutment. In this case, the two coupling projections are linked by means of a center portion which is shiftable in the abutment, preferably in the plane of the abutment. The abutment thus forms some kind of a housing to shiftably accommodate the center portion with the two coupling projections attached thereto.

The coupling piece also comprises a securing means which retains the coupling piece, which is inserted under an upper container by means of a rotation, in a prelocked position under the upper container, so that the coupling piece can not rotate back—and thus unlock—and the housing can not shift until the upper container is placed on top of the lower container.

Alternatively, the coupling piece as taught by the invention is designed such that as a whole it can be shifted relative to the containers to be connected. Such a coupling piece can be formed from one piece in a specially simple manner. In this case, a coupling projection is provided with at least one displacement means which is designed such that, at least when the containers are placed on top of one another, it effects longitudinal displacement of the whole coupling piece. Expediently, the whole coupling piece can be shifted by the displacement means when the containers are placed on top of one another in such a way that both coupling projections are moved to a locking position in which they hook behind the corner fittings of the containers which are to be connected.

A development of this coupling piece comprises a further (second) displacement means which precedes the anchoring lug. This displacement means serves for shifting the whole coupling piece—if necessary—when the containers are placed on top of one another in such a way that the anchoring lug can enter the corner fitting of the respective container. Thereafter, the coupling piece is shifted back by the (first) displacement means in the opposite direction, so that the anchoring lug can hook behind the corner fitting of the associated container in a positive manner. Both displacement means are each preferably formed by one sliding face on the lower coupling projection.

Expediently, this coupling piece also comprises a securing means which is located in the region of a middle part of the second coupling projection extending through the long hole of the corner fitting of the respective containers. This securing means also prevents that the coupling piece, after being prelocked under an upper container, can be released from the upper container by means of a possible backward rotation of the coupling piece. Expediently, the securing means is designed as a filling member of a recess located at a corner of the middle piece. If the filling member is in the recess of the middle piece, the latter has a cross-section which prevents a rotation of the coupling piece under the upper container. If, on the other hand, the filling member is moved out of the recess in the middle part, the coupling piece can be rotated to be prelocked under the upper container and to be removed therefrom.

It is another proposal of the invention to provide a glide plate or glide covering at least on that side of the abutment which is directed away from the first coupling projection comprising the anchoring lug. As a result, the coupling piece is easier to shift when the containers are being connected because the slide plate or slide covering ensures an easier gliding of the side of the abutment contacting the corner fitting of the upper container from below when the containers are placed on top of one another, in spite of the forces of reaction caused by the glide faces on the first coupling projection.

BRIEF DESCRIPTION OF THE DRAWINGS

Two preferred embodiments of the coupling piece as taught by the invention will be described below in detail with reference to the drawings, in which.

DETAILED DESCRIPTION OF THE PREFERRED EMBODIMENTS

Figure 8:
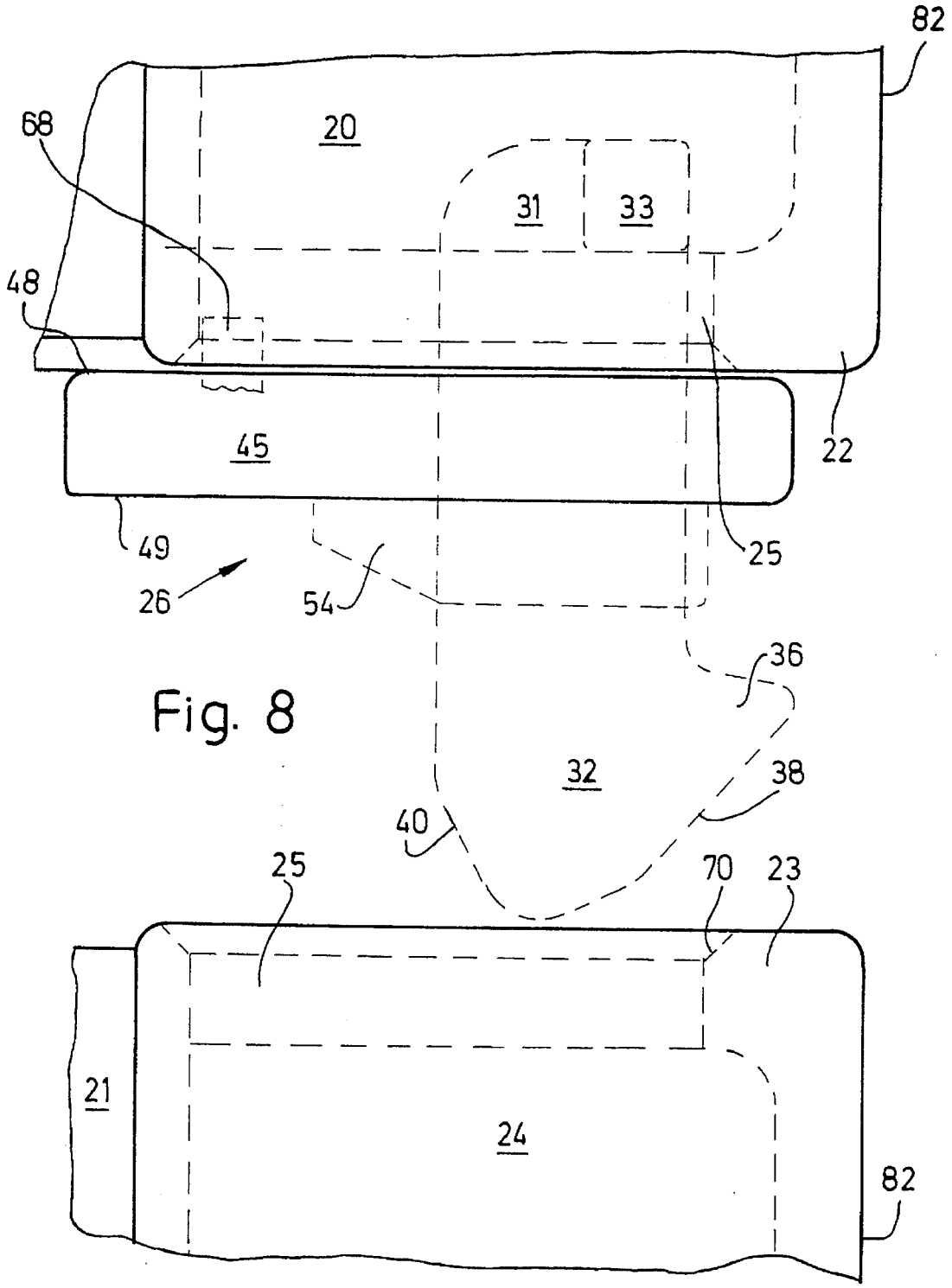
FIG. 8 is a view of the coupling piece under an upper container in a prelocked state.
Figure 14:
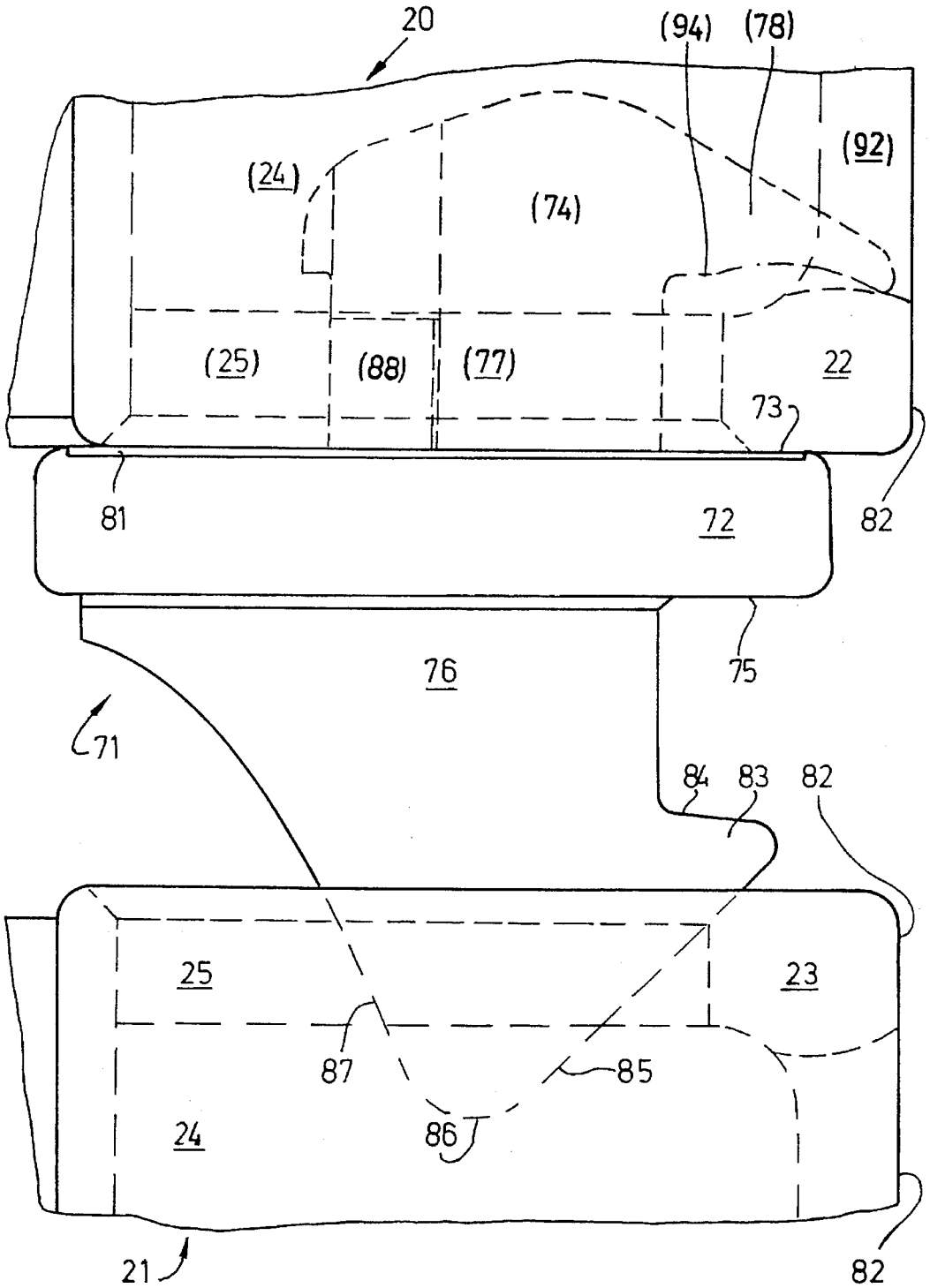
FIG. 14 shows the coupling piece prelocked under an upper container, before it is connected to a container located thereunder.

The coupling pieces illustrated in the drawings serve for connecting containers 20, 21 on board of ships. This connection is established on oppositely situated corner fittings 22, 23 of the containers 20, 21. The identically designed corner fittings 22 and 23 have cavities 24 which can be accessed from above or below through long holes 25 (FIGS. 8 and 14 ).

FIGS. 1 to 11 show a first embodiment of the coupling piece 26 as taught by the invention. This coupling piece 26 is formed from several parts. It is essentially composed of a housing 27 and a locking member 29 mounted therein in a horizontally shiftable manner transverse to the locking direction (double arrow) 28.

Figure 4:
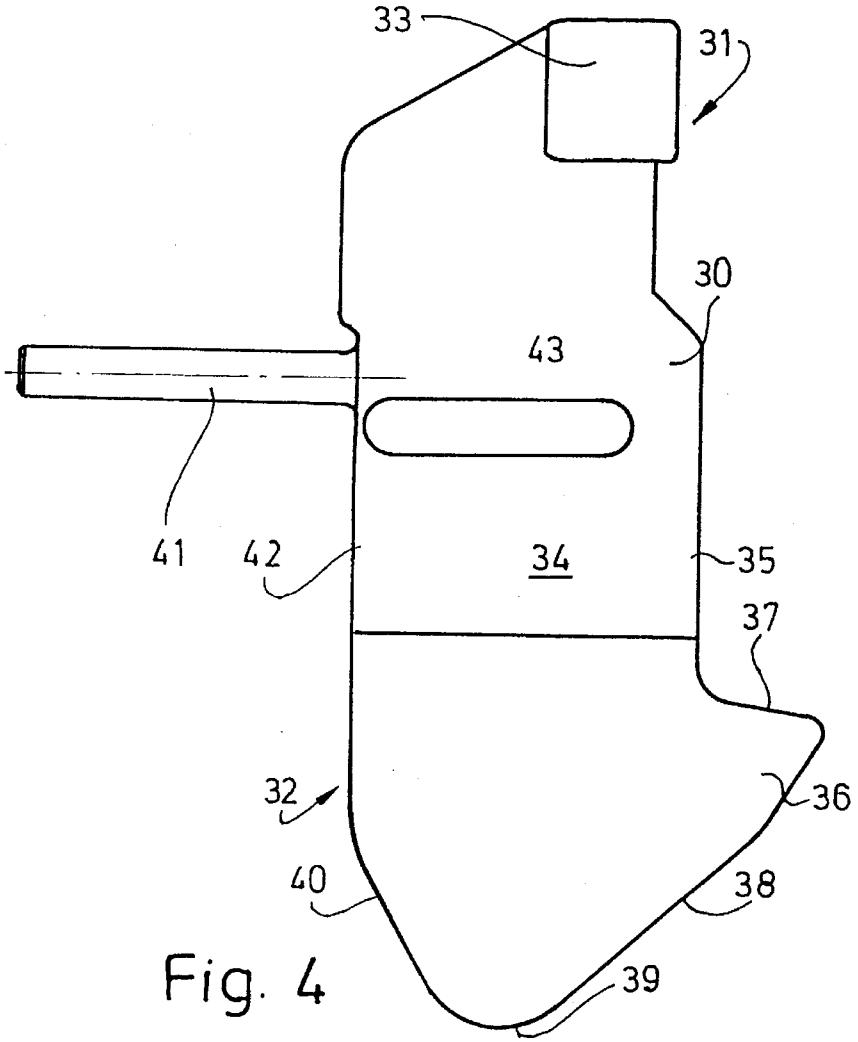
FIG. 4 is a side view of a locking member of the coupling piece.
Figure 5:
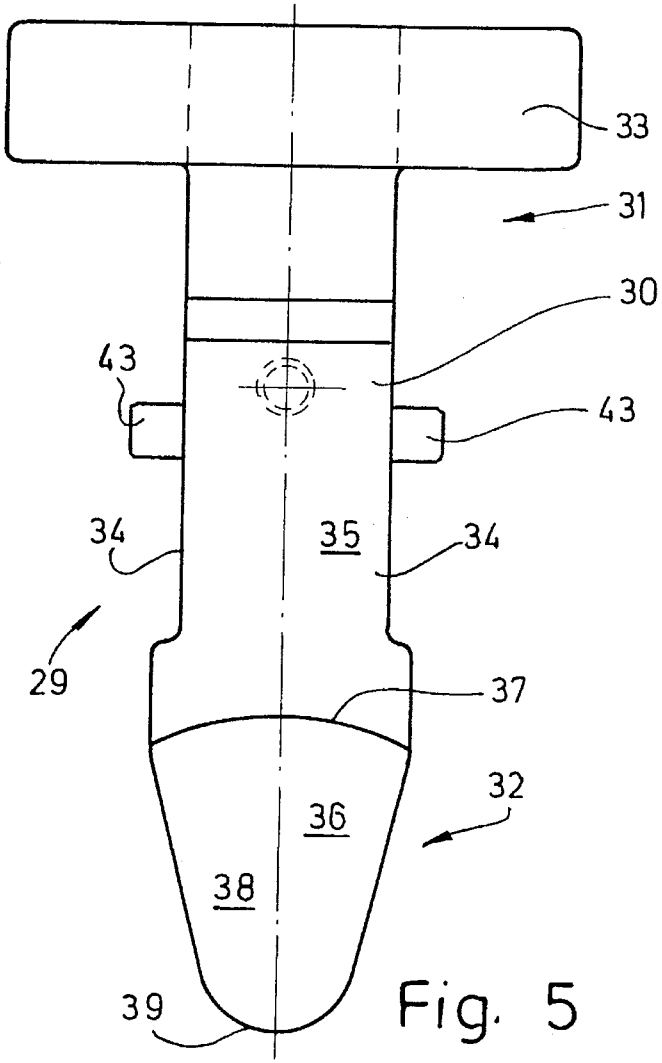
FIG. 5 is a front view of the locking member as shown in FIG. 4.

The locking member 9 is formed from a single piece and has a center portion 30 and two coupling projections 31, 32 formed on opposed sides of said center portion 30. The (upper) coupling projection 31 essentially forms an extension of the center portion 30. A horizontally extending crossbar 33 is arranged in an upper corner region of the (upper) coupling projection 31. Said crossbar 33 projects with opposed ends from opposite side faces 34 of the center portion 30 (FIGS. 4 and 5). The (lower) coupling projection 32 also forms an extension of the center portion 30 and is provided with an anchoring lug 36 projecting relative to an end face 35 extending transverse to the side faces 34. On its top side, the anchoring lug 36 has an anchoring face 37 extending almost transverse to the end face 35. The region of the (lower) coupling projection 32 located thereunder is designed essentially coniform. An end face of the (lower) coupling projection 32 which is located below the anchoring lug 36, namely a glide face 38, is distinctly inclined. This glide face 38 extends from a vertex located approximately centrally below the center portion 30. A second glide face 40 also extends from the vertex 39 in the opposite direction relative to tile first glide face 38, specifically in such a way that, in a view of a side face 34, the (lower) coupling projection 32 has an approximately V-shaped cross-section (FIG. 4).

Moreover, both side faces 34 of the center portion 30 have elongate guide webs 43 extending transverse to the locking direction 28 and projecting from the side faces 34 (FIGS. 4 and 5 ).

Figure 6:
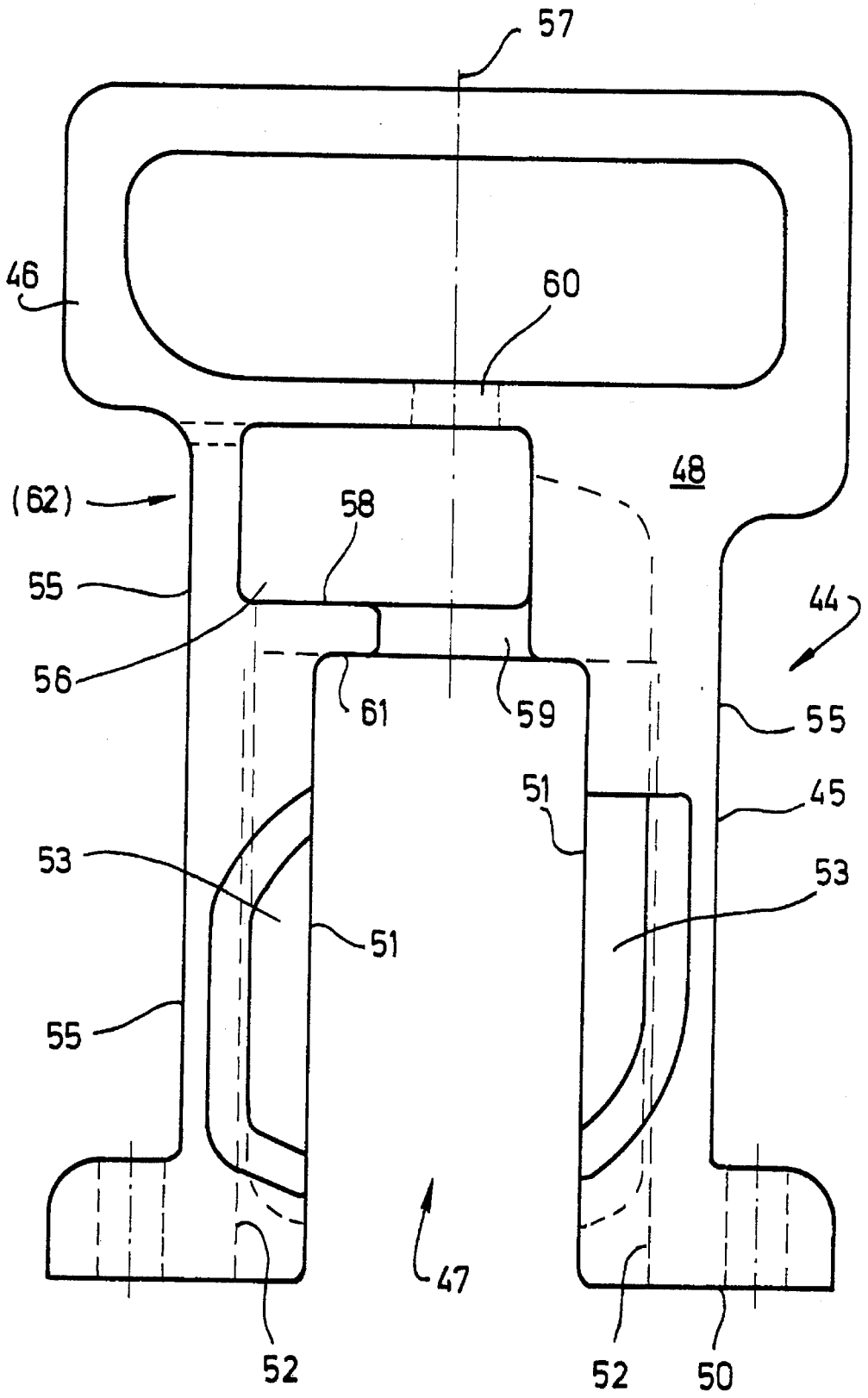
FIG. 6 is a top plan view of a housing of the coupling piece.
Figure 7:
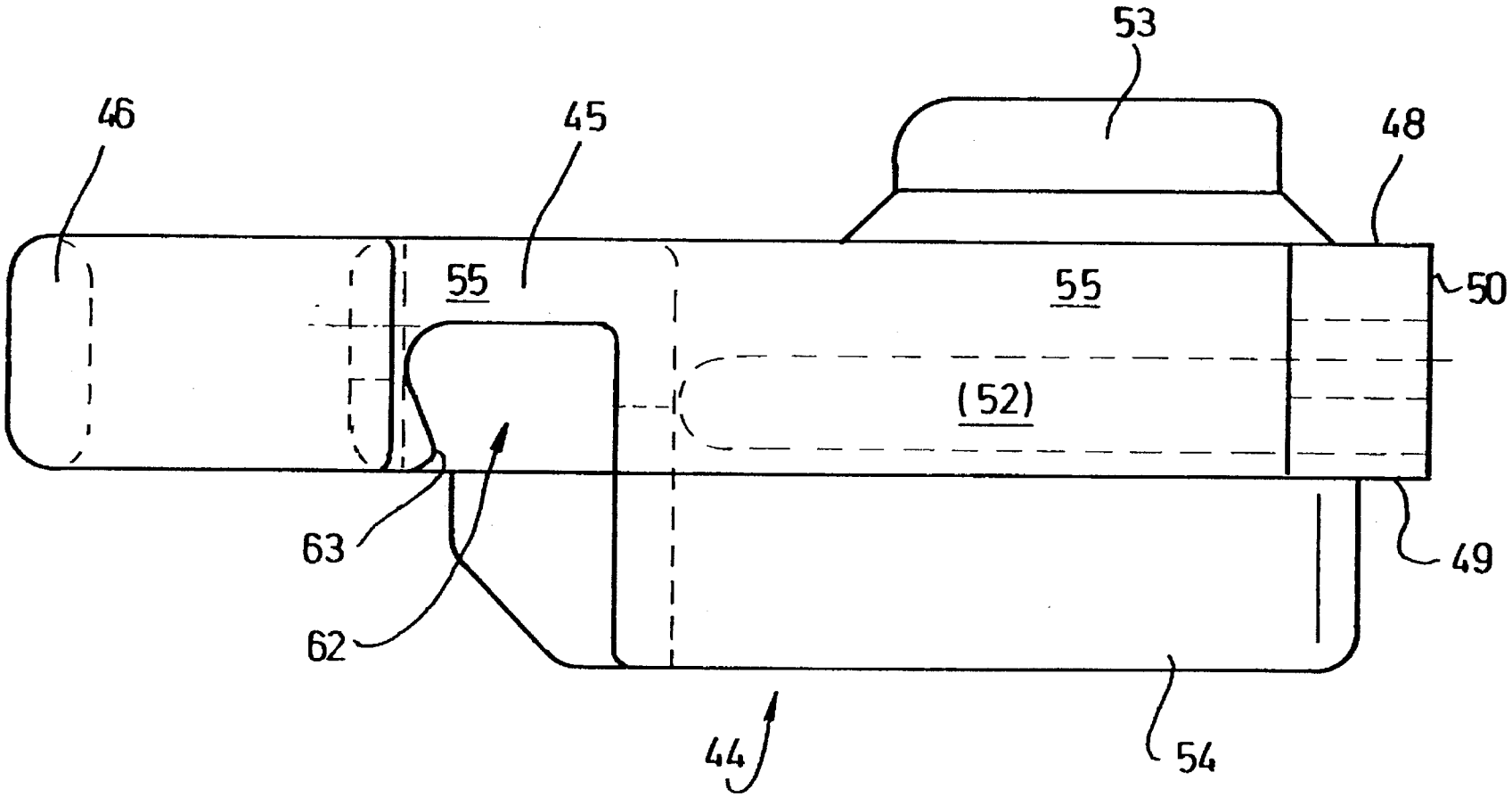
FIG. 7 is a side view of the housing as shown in FIG. 6.

The housing 27 has a base part 44 which essentially comprises an abutment 45 extending transverse to the locking direction 28 and a unilaterally formed handle 46. This abutment 45 acts as a spacer between the confronting corner fittings 22, 23 of the containers 20, 21 stacked on top of one another. An elongate recess 47 is arranged in the abutment 45 of the housing 27. This recess 47 continuously extends between a top side 48 and a bottom side 49 of the abutment 45 and is open on one side, namely on an end side 50 of the abutment 45 which is directed away from the handle 46. The dimensions of the recess 47 are defined such that it accommodates the center portion 30 of the locking member 29 so that it can be moved backwards and forwards therein. Parallel (long) edge faces 51 of the recess 47 are provided with continuous grooves 52 which are also open towards the end side 50 of the abutment 45. The dimensions of the grooves 52 are defined such that the guide webs 43 of the center portion 30 of the locking member 29 can glide along therein (FIGS. 6 and 7).

Two centering projections 53 are arranged on the top side 48 of the abutment 45 and project from the top side 48 and are flush with the edge faces 51 of the recess 47. One centering projection 53 is rounded on both ends, while the opposite centering projection 53 is only rounded on one end (FIG. 6). As a result and in conjunction with an appropriately selected length of the centering projections 53, it is ensured that for a prelocking of the coupling piece 26 under an upper container, said coupling piece 26 is rotatable in the long hole 25 of the corner fitting 22 up to a stop formed by the non-rounded edge of a centering projection 53. The bottom side 49 of the abutment 45 is also provided with two oppositely situated centering projections 54. These are also flush with the edge faces 51 of the recess 47 but they extend approximately over the entire length of the recess 47. The distance between the outer faces 55 of the centering projections 54 is defined such that said projections 54 can be inserted into the long hole 25 of the respective corner fitting 23.

Moreover, the housing 27 has a clearance 56 passing through between the top side 48 and the bottom side 49 in the region between the recess 47 and the handle 46. This clearance 56 is located off center relative to a longitudinal mid-axis 57 extending through the housing 27 (FIG. 6). The housing 27 is also provided with through bores 59 and 60 starting from opposite transverse side faces 58 of the clearance 56. Both through bores 59 and 60 are located on the longitudinal mid-axis 57 and extend in the direction of said axis. The through bore 59 is located between a respective transverse side face 58 of the clearance 56 and an end face 61 of the recess 47. This through bore 59 has a larger diameter than the oppositely situated through bore 60 located between the other transverse side face 58 of the clearance 56 and a respective inner face of the handle 46 (FIG. 6). The side of the clearance 56 which is furthest from the longitudinal mid-axis 57 of the housing 27 is provided with a connecting hole 62 leading to the outer side of the abutment 45. This connecting hole 62 starts from the bottom side 49 of the abutment 45 and is provided with an inclined anchoring projection 63 on a side directed towards the handle 46 (FIG. 7).

Figure 1:
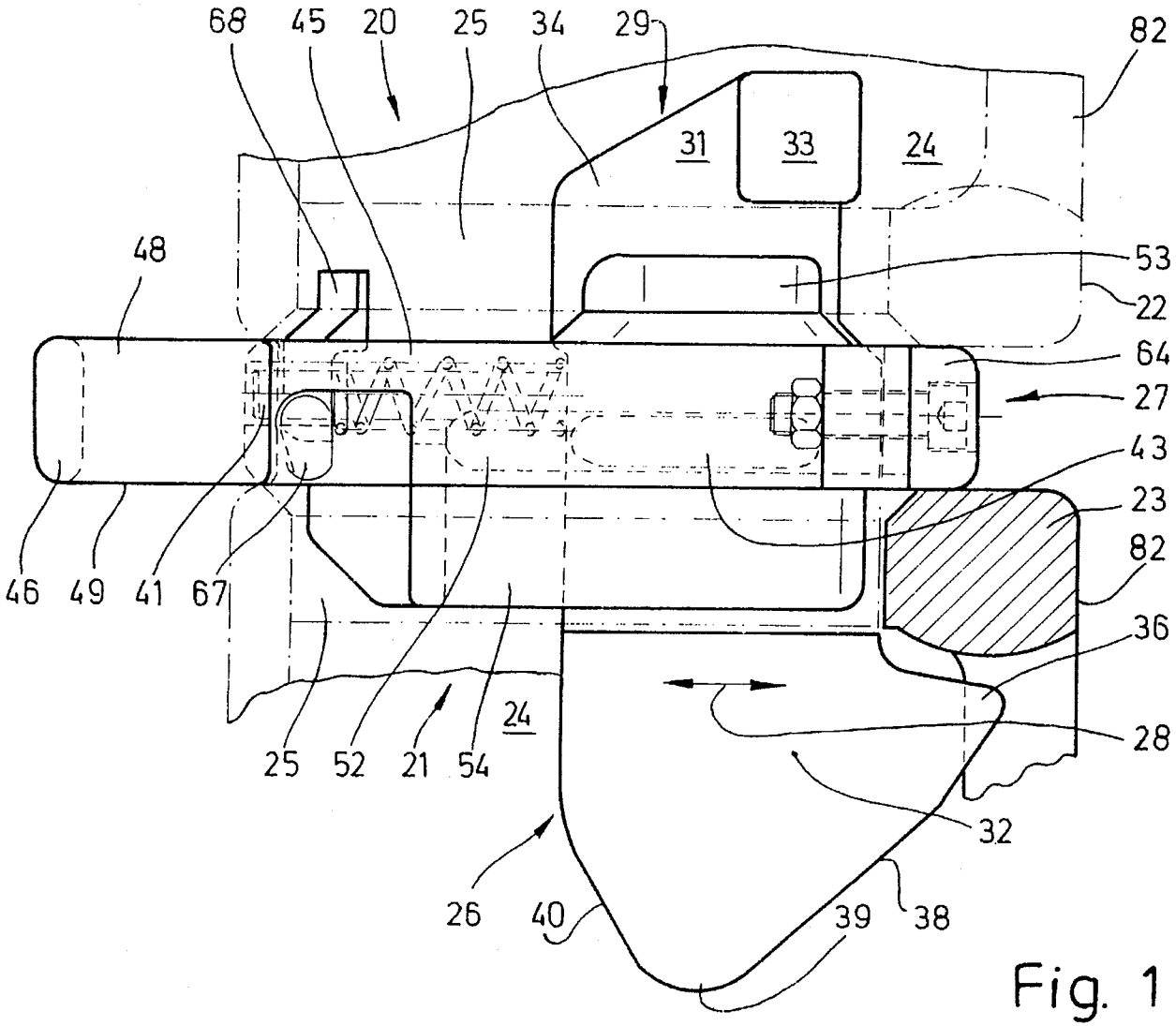
FIG. 1 is a side view of a first embodiment of a coupling piece in a locked state.

The locking member 29 is inserted into the housing 27 in a longitudinally shiftable manner in such a way that the center portion 30 is partially held in the recess 47 and is shiftable therein. This is ensured, on the one hand, by the guide webs 43 on the center portion 30 and, on the other hand, by the grooves 52 in the edge faces 51 of the recess 47. The (upper) coupling projection 31 projects from the top side 48 of the abutment 45, while the (lower) coupling projection 32 projects from the bottom side 49 of the abutment 45. The relative arrangement of the locking member 29 in the housing 27 is defined such that the anchoring lug 36 on the (lower) coupling projection 32 is directed away from the handle 46 (FIG. 1).

Figure 2:
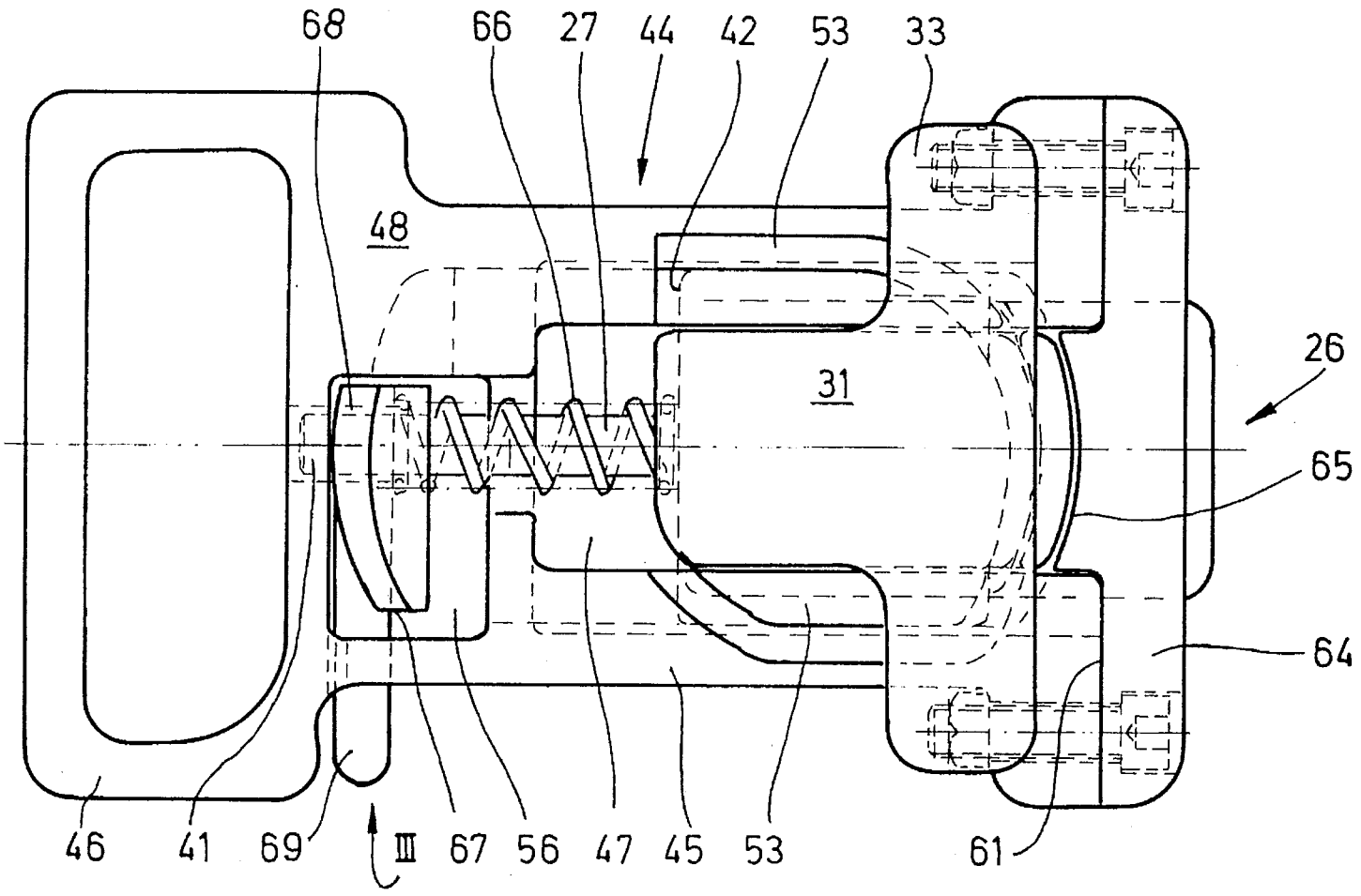
FIG. 2 is a top plan view of the coupling piece as shown in FIG. 1.

After it is inserted into the recess 47 in the housing 27, the locking member 29 is secured by a closing piece 64 of the housing 27 which is screwed against the end side 50 of the abutment 45. This closing piece 64 has a central centering projection 65 which projects into the open side of the recess 47 and thus serves, on the one hand, for centering the closing piece 64 relative to the abutment 45 and, on the other hand, as a stop for defining an end position of the locking member 29 in the housing 27 (FIG. 2).

A pin-like journal 41 is formed on the center portion 30 and projects from a (rear) end face 42 of the center portion 30 which is directed away from the anchoring lug 36 (FIG. 4).

Figure 3:
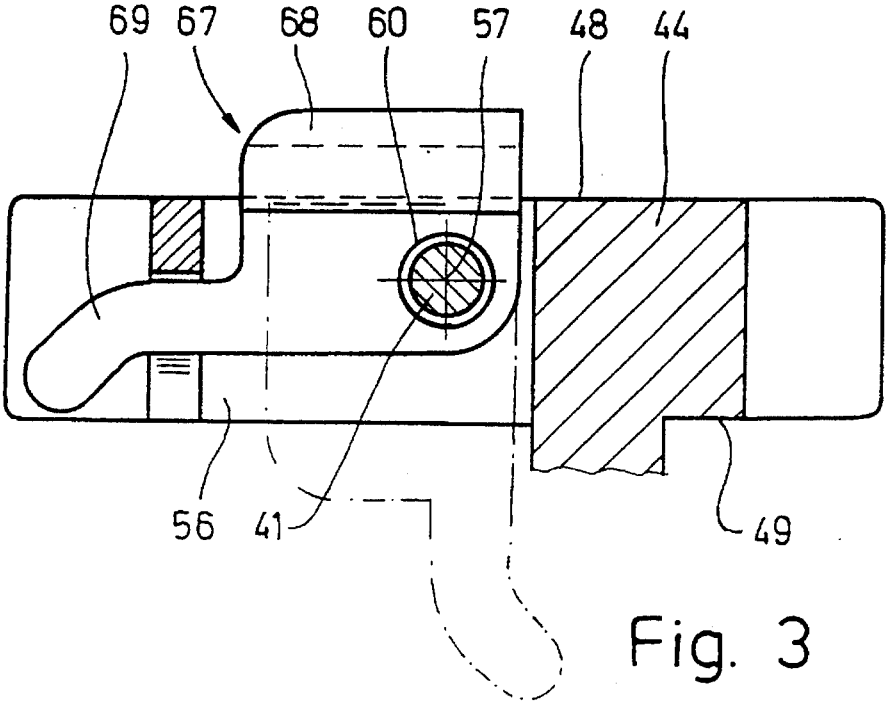
FIG. 3 is a view III of a securing means on an enlarged scale.

When the locking member 29 is inside the housing 27, the journal 41 on the center portion 30 projects through the through bore 59 and 60 in the abutment 45. A pressure spring 66 is mounted on the journal 41. Furthermore, a locking lever 67 is rotatably located on the journal 41 and is accommodated in the clearance 56. This locking lever 67 can be rotated about the journal 41 which is lying on the longitudinal mid-axis 57 (FIG. 3). The pressure spring 66 is supported on the end face 42 of the center portion 30 and on the end face of the locking lever 67 which is directed to face said end face 42 of the center portion 30 (FIG. 2). Consequently, the presses the spring 66 presses the locking member 29 against the closing piece 64, i.e. into an end position in the housing 27, which corresponds to the locking position of the coupling piece 26 (FIG. 1).

In its upwardly pivoted position (FIG. 3), the locking lever 67 projects with a locking projection 68 from the top side 48 of the abutment 45, specifically into the long hole 25 of the respective corner fitting 22. In this position, the locking lever 67 is secured by a pivoting lever 69 which is held by the anchoring projection 63 on the connecting hole 62 (FIG. 7). When the locking lever 67 is pivoted anticlockwise through 90° (dot-dash line in FIG. 3), the locking projection 68 completely enters the clearance 56 and thus does no longer project from the top side of the abutment 45.

The containers 20 and 21 are locked and unlocked with the coupling piece 26 as follows:

First of all, the coupling piece 26 is prelocked with the (upper) coupling projection 31 on the lower corner fitting 22 of the upper container 20, specifically via an anchoring lug 36 directed towards an end side 82 of the containers 20, 21. For this purpose, tile locking lever 67 is pivoted back (dot-dash line in FIG. 3), so that the locking projection 68 does not project from the top side 48 of the abutment 45. Then, the coupling piece 26, which is on the whole held by the handle 46 and which is rotated in the corner fitting 22 relative to the longitudinal direction of the long hole 25, can be inserted into the corner fitting 22 from below. After rotating the coupling piece 26 back, the crossbar 33 on the (upper) coupling projection 31 reaches a position directed transverse to the long hole 25 of the corner fitting 22, and in this position, oppositely situated ends of the crossbar 33 hook behind the long hole 25 and positively prelock the coupling piece 26 under the upper container 20. To avoid an automatic rotation of the coupling piece 26 which could move it out of the prelocking position with the upper container 20 before it is placed on the lower container 21, the locking lever 67 is pivoted clockwise through 90°, so that the locking projection 68 projects from the top side 48 of the abutment 45 and enters the long hole 25 of the corner fitting 22.

Figure 9:
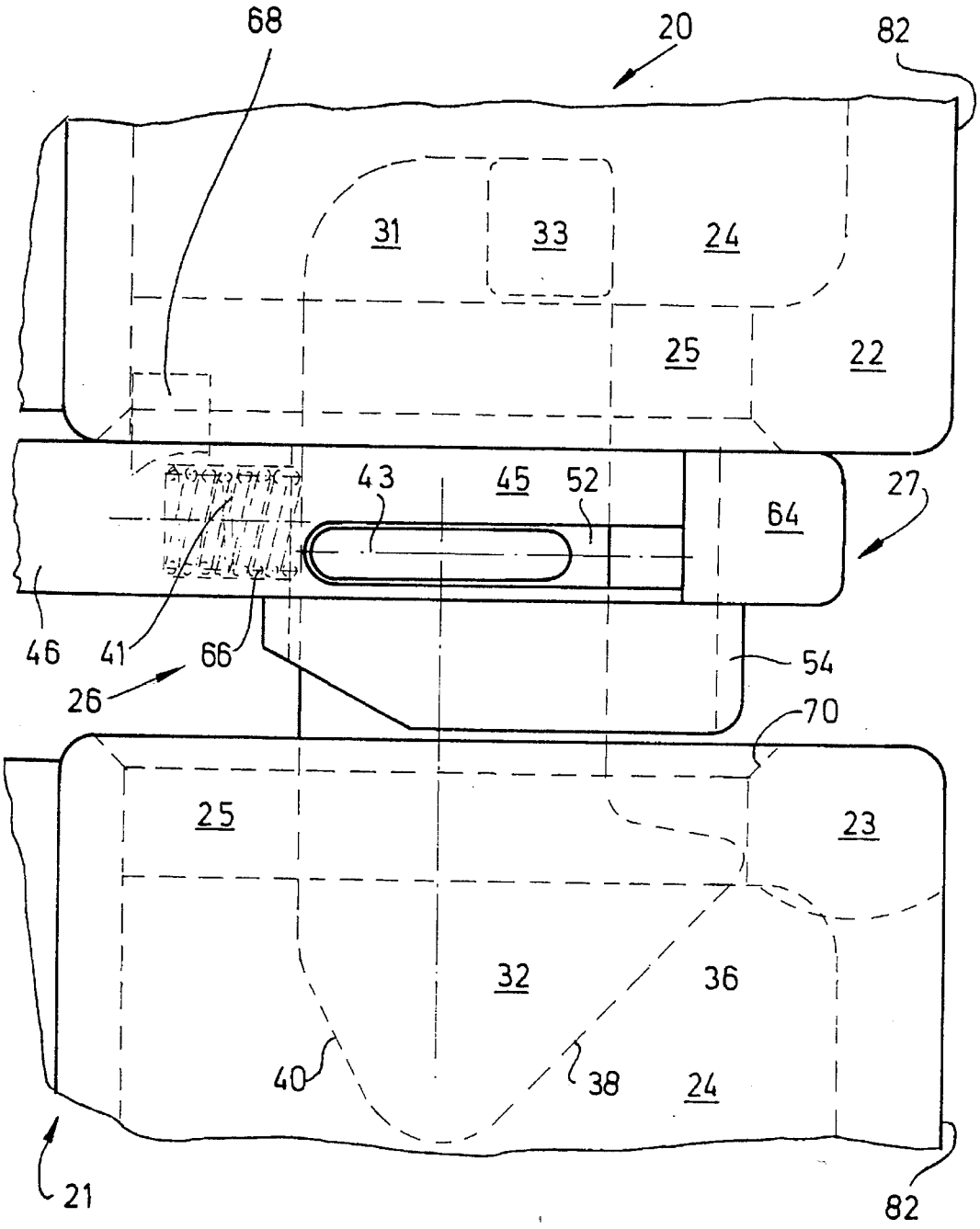
FIG. 9 is a side view of the coupling piece shortly before it is locked to a lower container.

Now, the upper container 20, together with the prelocked coupling piece 26, is placed on top of a container 21 already located on board of a ship which is to be loaded. In this process, the coupling piece 29 is already in the locked position to start with, because the pressure spring 66 of the locking member 29 presses against the closing piece 64 of the housing 27. The anchoring lug 36 on the (lower) coupling projection 32 is partially located beyond the region of the long hole 25 in the lower corner fitting 23 (FIG. 8). As the upper container 20 is lowered further, the first glide face 38, which is located below the anchoring lug 36, contacts an upper edge chamber 70 of the long hole 25 in the upper corner fitting 23 of the lower container 21. As the upper container 20 is lowered further and because of the correspondingly inclined design of the glide face 38, the locking member 29 is pressed counter to the pressing direction of the pressure spring 66 and in the direction towards the handle 46, which biases the pressure spring 66 (FIG. 9). In this process, the housing 27 is not displaced because of the centering projections 54 underneath the abutment 45. As soon as the anchoring lug 36 has passed the long hole 25 of the corner fitting 23, the pressure spring 66 presses the locking member 29 back against the closing piece 64 and the anchoring lug 36 positively hooks behind a portion of the corner fitting 23 which is adjoining the long hole 25 (FIG. 1). Herewith, the containers 20 and 21 are locked together.

Figure 10:
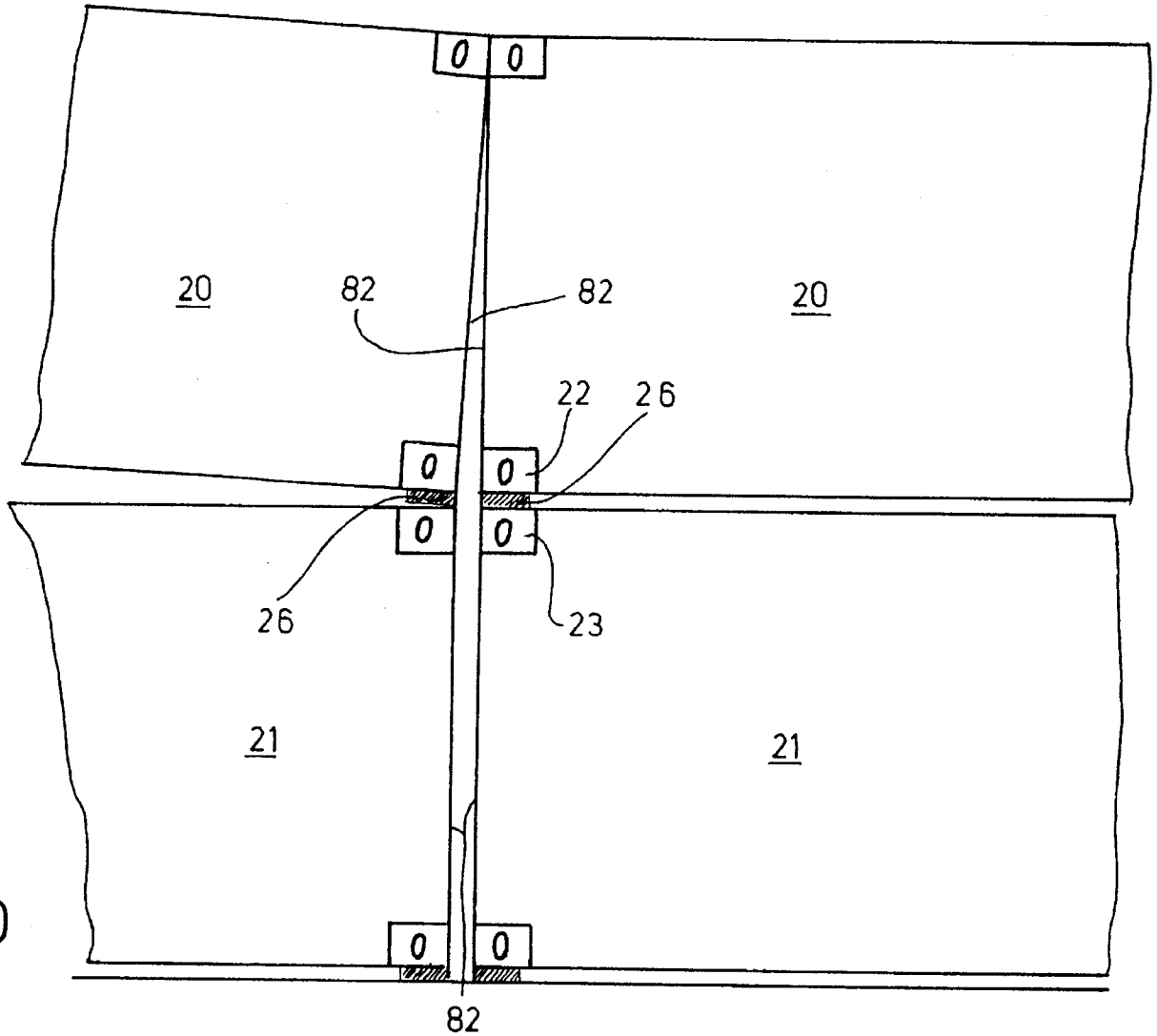
FIG. 10 is a side view of a stack of containers with one container moved to a release position.
Figure 11:
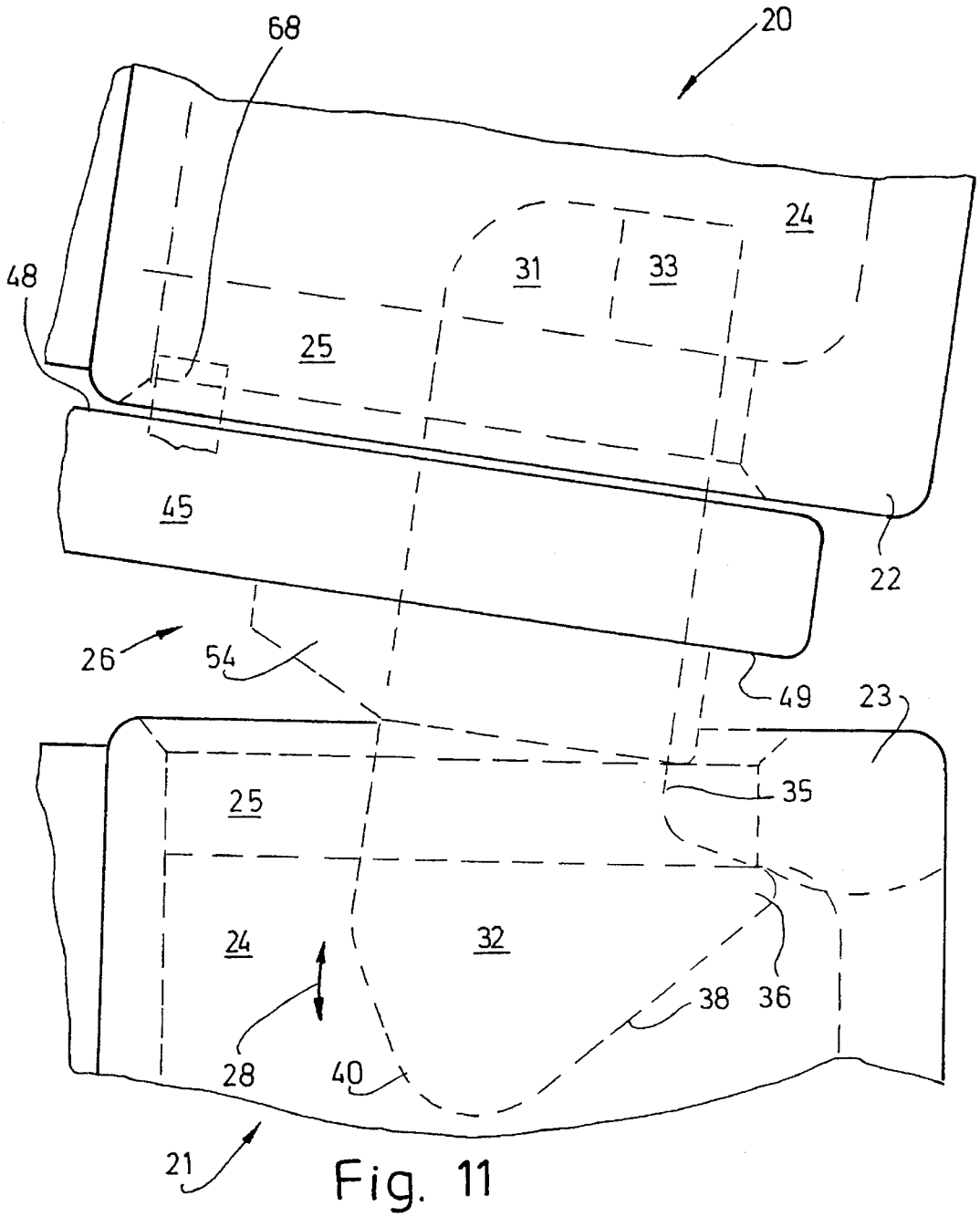
FIG. 11 shows the coupling piece before being released.
Figure 12:
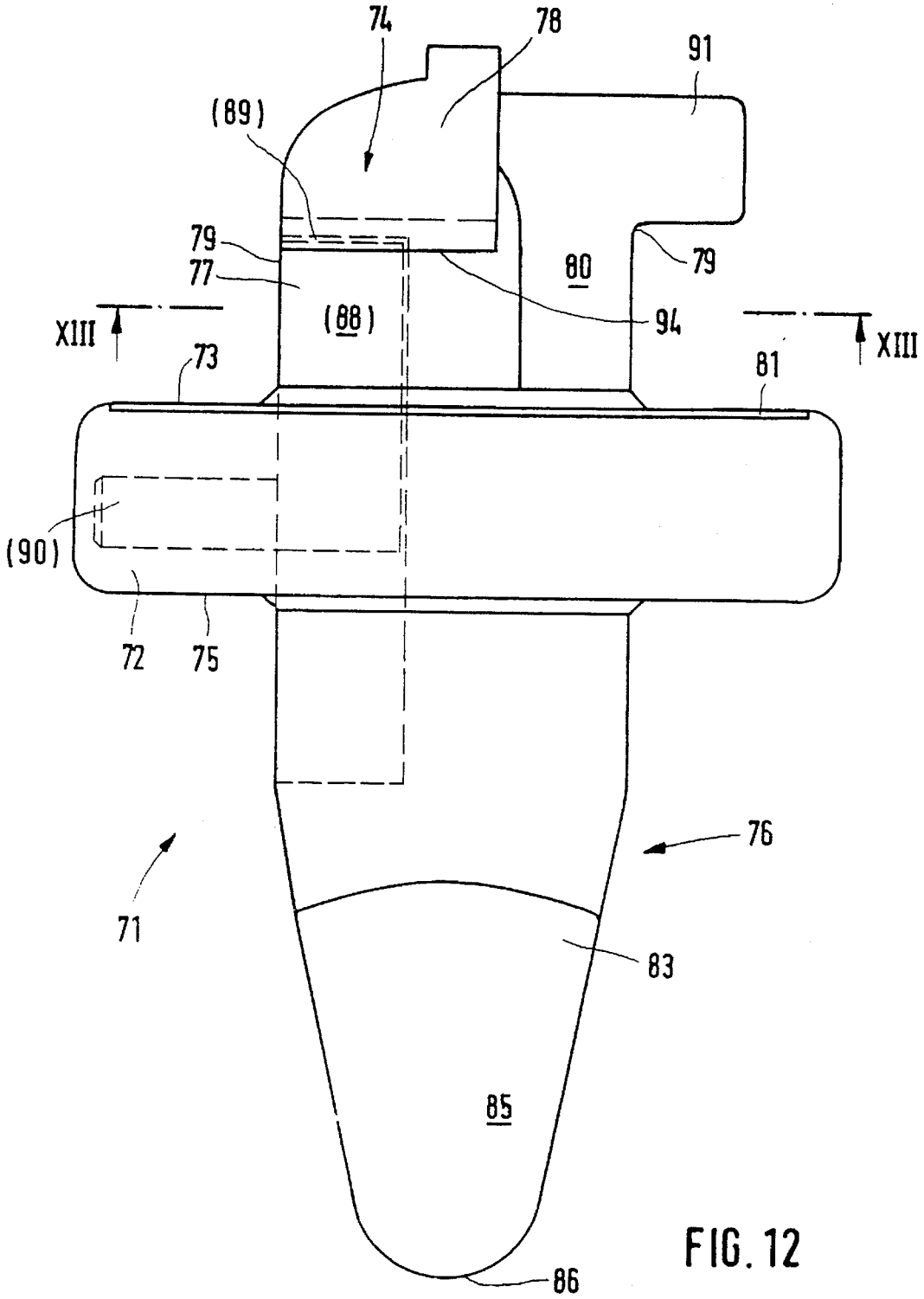
FIG. 12 is a side view of a second embodiment of a coupling piece.

The coupling pieces 26 can be released without any manual action, if two coupling pieces 26 as taught by the invention are assigned to an end portion of an end side of each container 20 and 21 and if coupling pieces with rotatable projections (twistlocks), such as those disclosed in DE-OS 37 10 419, are used on opposite end portions of the end faces of the container. After the two ordinary twistlocks, for example the known semi-automatic twistlocks, have been released, the upper container 20 is slightly lifted to an inclined position (FIG. 10). In this position, upper corner fittings of the upper container 20 contact one another and thus the lower corner fitting 22 of the upper container 20 is shifted relative to the upper corner fitting 23 of the lower container 21. As a result of this displacement, the anchoring lug 36 of the (lower) coupling projection 32 of each coupling piece 26 is moved to the region of the long hole 25 of the respective corner fitting 23, which automatically releases the connection of the containers 20 and 21 which was established by the two coupling pieces 26 as taught by the invention (FIG. 11).

FIGS. 12 to 16 illustrate a second embodiment of a coupling piece 71 as taught by the invention. This coupling piece 71 is essentially formed from a single piece and has a central abutment 72 with an (upper) coupling projection 74 projecting from the top side 73 and a (lower) coupling projection 76 projecting from the bottom side 75 of this abutment 72.

The (upper) coupling projection 74 has a special design (FIG. 12) and comprises a middle part 77 extending the abutment 72 and two anchoring lugs 78 and 91 arranged on the end of this middle part 77. These anchoring lugs 78, 91 project from two adjacent and perpendicularly extending side faces 79. As a result, the anchoring lugs 78, 91 extend in different directions at right angles to one another. The anchoring lug 78 projects from the middle piece 77 in the direction towards the end side 82 (or door side) of the container 20. The anchoring lug 91, on the other hand, attached to the middle piece 77 such that it is directed towards the respective longitudinal side of the container 20. Thus, the anchoring lugs 78 and 91 each point towards one vertical long hole 92 of the respective corner fitting 22 of upper containers 20. As a result, the coupling piece can only be locked under the corner fittings 22 of a respective upper container 20 in a certain relative position. In an incorrect relative position of the coupling piece, at least one anchoring lug 78 or 91 of the coupling piece 71 would point to a closed side of the corner fitting 22 and the coupling piece could not be inserted into the corner fitting 22 because of the absence of a vertical long hole 92.

Figure 16:
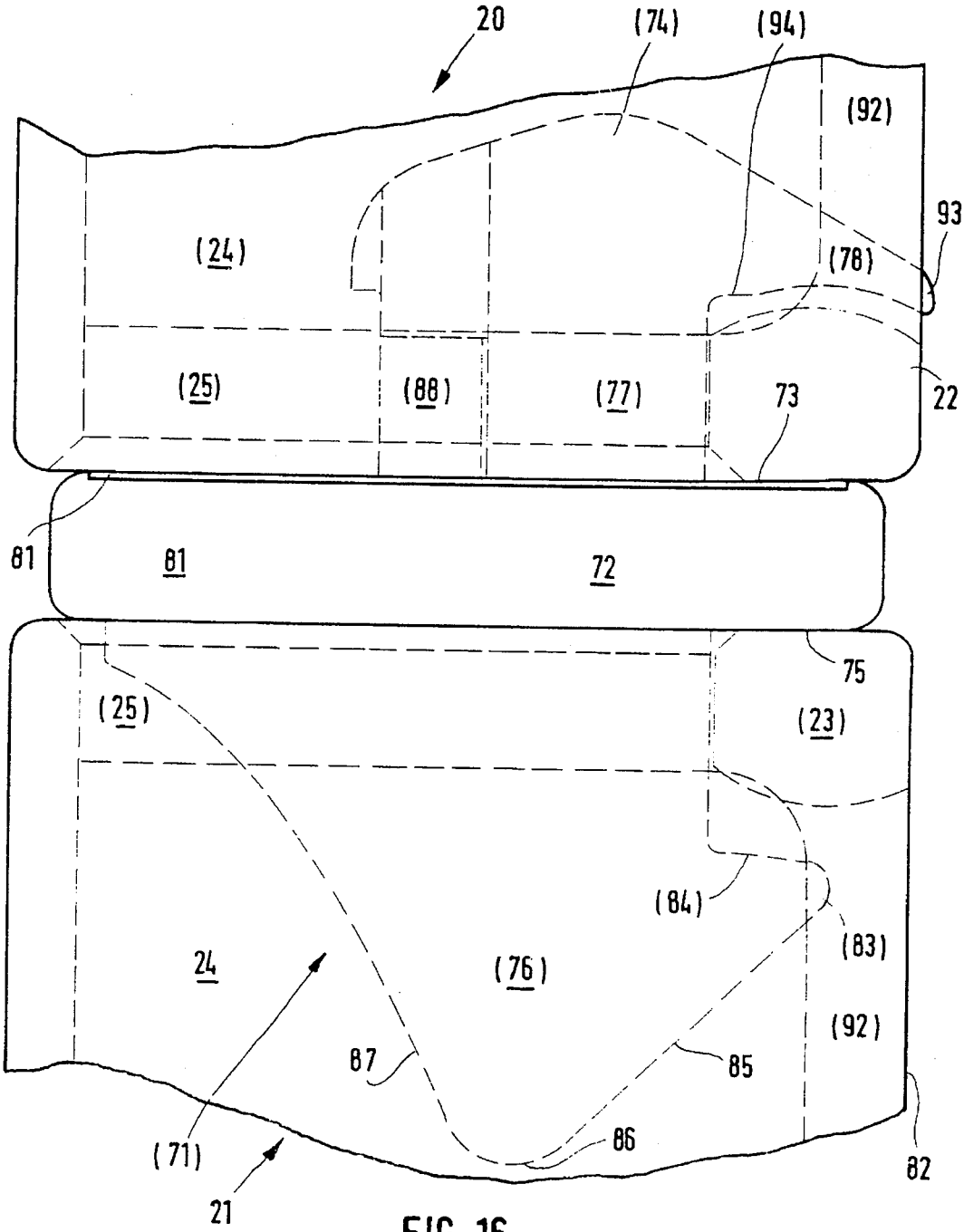
FIG. 16 shows the coupling piece in a locked state.

According to an essential feature of the invention, the anchoring lug 78 has such a length that it completely passes through the associated vertical long hole 92 and projects the refrom towards the outside with a short end portion 93 (FIG. 16). Because of a depression preferably in the form of a concave design of a bottom side 94 of the anchoring lug 78, the coupling piece 71, which has been inserted into the corner fitting 22, can not automatically move out of the locking position after the containers 20 and 21 are locked together.

A covering 81 with good gliding properties is arranged on the top side 73 of the abutment 72. This covering 81 preferably consists of a plate made of polytetrafluoroethylen which is attached to the top side 73 of the abutment 72. It would also be possible to pour the covering 81 upon the top side 73 of the abutment 72.

The (lower ) coupling projection 76 is provided with an anchoring lug 83 on the side which is directed towards the end side 82 (or door side) of the container 83. Consequently, the anchoring lugs 83 and 78 project from the same side of the middle piece 77 (FIG. 14). The anchoring lug 83 is formed similar to that of the coupling piece 26 and is provided with an almost horizontally extending (flat) anchoring face 84. The portion of the (lower) coupling projection 76 which is located directly below the anchoring face 84 has an approximately V-shaped form. As a result, the anchoring face 84 of the anchoring lug 83 adjoins a first glide face 85 which extends to a vertex 86 located approximately centrally below the abutment 72, and an oppositely directed glide face 87 extends from this vertex 86. This glide face 87 is designed in a special way. It extends in a curve, specifically concavely, and relatively steep in relation to the locking direction 28. This special design of the glide face 87 ensures that when the containers 20 and 21 are placed on top of one another, the whole coupling piece 71 is shifted in the direction of the end side 82 of the container 21, which brings the anchoring lug 83 in a position in which it hooks behind the portion of the corner fitting 23 which adjoins the long hole 25 (FIG. 16). If required, the glide face 87 and/or the glide face 85 can also be provided with a glide covering, for instance made of polytetrafluoroethylen.

Figure 13:
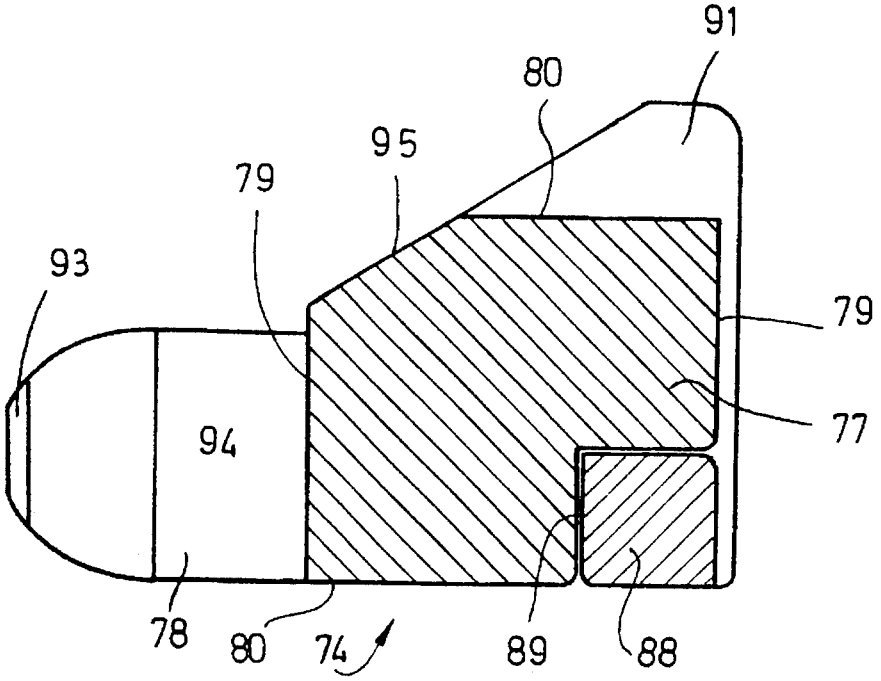
FIG. 13 is a section of a middle part of a second coupling projection of the coupling piece, taken along the line XII-I–XIII.

The coupling piece 71 also has a securing means preventing an automatic rotation which would release the prelocking of the coupling piece under the upper container 20. This securing means consists of a filling member 88 which is formed to correspond to a (square) recess 89 located on an edge of the rectangular middle piece 77 of the (upper) coupling projection 74 (FIG. 13). The filling member 88 can be moved up and down in the locking direction 28, such that in the securing position it fills the recess 89, i.e. it is pushed up, and in the final locking position it clears the recess 89 and is completely inserted into the abutment 72. When the recess 89 is clear, the coupling piece 71 can be inserted through the long hole 25 and into the corner fitting 22 of an upper container 20 by means of an appropriate rotation. This process is facilitated by a bevel 95 on the middle piece 77 which is located diagonally opposite the recess 89 (FIG. 13). After prelocking, the filling member 88 is automatically pushed up into the recess 89 by means of a spring mechanism arranged outside the filling member. This spring mechanism may simply consist of a pressure spring (not illustrated) partially accommodated in the (lower) coupling projection 76. An actuating journal 90 is provided in the region of the bottom side of the filling member 88 and extends transverse thereto. When the filling member 88 is inside the recess 89, this actuating journal 90 is located in the region of the abutment 72 (FIG. 13).

The process of prelocking, locking and releasing the coupling piece 71 corresponds in principle to that of the coupling piece 26, so that in the following only those steps of handling the coupling piece 71 will be described, which are different therefrom.

To prelock the coupling piece 71 under the lower corner fitting 22 of the upper container 20, the filling member 88 is first pushed down by hand with the actuating journal 90 counter to the spring tension of the spring mechanism arranged thereunder, so that the recess 89 in the middle piece 77 of the (upper) coupling projection 74 is cleared. Then, the anchoring lugs 8 and 91 of the (upper) coupling projection 74 can be inserted through the long hole 25 and into the corner fitting 22 by means of an appropriate displacement of the coupling piece 71 relative to the long hole 25 of the corner fitting 22 and an appropriate rotation of the coupling piece 71. The anchoring lugs 78 and 91, which are arranged at right angles to one another and are assigned to the middle piece 77, ensure that the coupling piece 71 can only be prelocked in one relative position under the corner fitting 22 of the (upper) container 20, as only in one (correct) relative position of the coupling piece 71, the anchoring lugs 78 and 91 pass through the also perpendicularly arranged vertical long holes 93 in the corner fitting 22.

Subsequently, the coupling piece 71 is rotated back until the crossbar 78 extends essentially transverse to the long hole 25. Now, the coupling piece 71 has reached the prelocking position. The coupling piece 71 is secured in this position automatically simply by letting the actuating journal 90 go, so that the spring mechanism can push the filling piece 88 into the recess 89, which gives the middle piece 77 an almost completely square or rectangular cross-section (FIG. 13) and prevents an automatic rotation of the coupling piece 71 out of the prelocking position.

Figure 15:
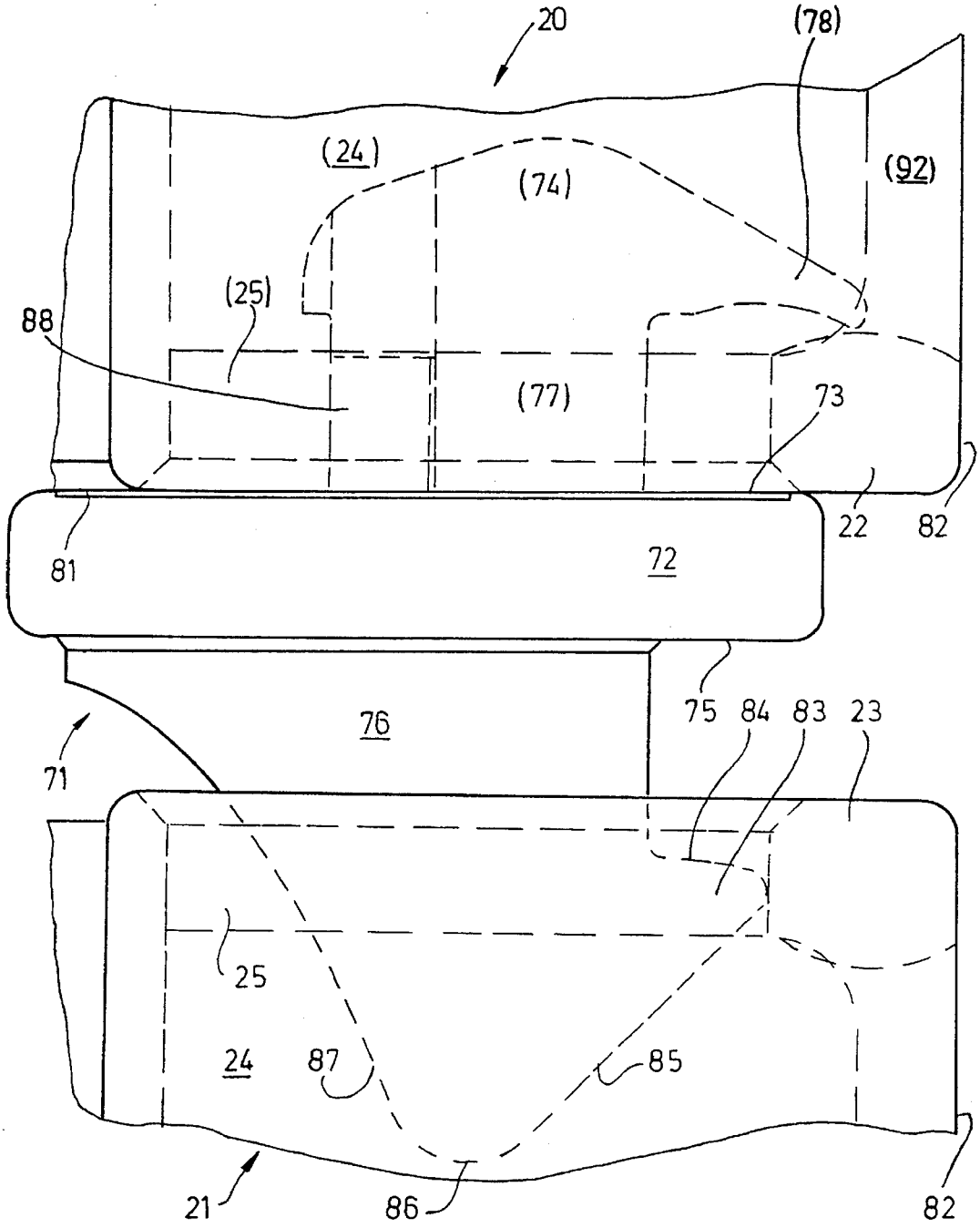
FIG. 15 shows the coupling piece in a position just before the locking position.

The containers 20 and 21 are connected to one another when they are subsequently placed on top of one another by means of a complete displacement of the coupling piece 71. If the coupling piece 71 has been prelocked under the upper container 20 such that it is already in the locking position (FIG. 14), the glide face 85 illustrated on the right hand side effects a displacement of the coupling piece 71 away from the end face 80 of the container 20 and 21, until the anchoring lug 83 can enter the corner fitting 23 through the long hole 25 (FIG. 15). As soon as the anchoring lug 83 has passed the long hole 25, the whole coupling piece 71 is moved in the opposite direction of the end faces 80 of the containers 20 and 21 (FIG. 16) by means of the appropriately designed glide face 87 in the course of the lowering of the upper container 20 down onto the lower container 21. In this process, the glide face 87 bears on the end portion of the long hole 25 of the corner fitting 23 which is directed away from the anchoring lug 83. Thus, the coupling piece 71 reaches the locking position in which the anchoring lug 83 hooks behind an edge portion of the corner fitting 23 adjoining the long hole 25. At the same time, the anchoring lug 78 reaches a position in which it hooks behind the edge portion of the long hole 25 of tile corner fitting 22 (of the upper container 20) (FIG. 16). In this position, the concave depression on the bottom side 94 of the anchoring lug 78 embraces a lower edge portion of the associated vertical long hole 92 of the corner fitting 22 to prevent an automatic displacement of the coupling piece 71 out of the locking position.

Moving the coupling piece 71 backwards and forwards to lock the containers 20 and 21 is facilitated by the good gliding properties of the covering 81 on the top side 73 of the abutment 72. When the containers 20 and 21 are placed on top of one another, this covering 81 is pushed against the bottom side of the corner fitting 22 of the upper container 20 by the force of reaction caused by the glide face 85 or 87. In this process, the covering 81 bears the vertically directed force component of the glide face 85 or 87, while the vertically directed force component is used for shifting the coupling piece 71 into the locking position or into the releasing position for establishing the connection of the containers 20 and 21. In this process, the covering 81 ensures that the opposed horizontal force component caused by the friction between the top side 73 of the abutment 72 and the bottom side of the corner fitting 22 does not negative the horizontal force component effected by the glide face 85 or 87 even under difficult conditions, so that a transverse displacement of the coupling piece 71 which is required for correct automatic locking of the container 20 and 21 by the coupling pieces 71 is ensured.

We claim:

1. A coupling piece and a pair of containers, each container having at least one corner fitting and a mounting hole therein for connecting the containers, said coupling piece being adapted to connect said containers and including an abutment adapted to be located essentially between the containers to be connected, a locking member shiftably mounted in said abutment, said locking member including first and second coupling projections located on two opposed sides of the abutment and adapted to extend into oppositely opposed mounting holes in said corner fittings of said containers, means for shifting the locking member relative to the abutment in one direction in order to insert said first coupling projection into one of said opposed mounting holes and means for shifting the locking member relative to the abutment in another direction after said first coupling projection has been inserted into said one mounting hole, wherein the locking member of said coupling piece includes a center portion which is mounted to the abutment in a longitudinally shiftable manner and which connects the coupling projections to one another.

2. A coupling piece and a pair of containers, each container having at least one corner fitting and a mounting hole therein for connecting the containers, said coupling piece being adapted to connect said containers and including an abutment adapted to be located essentially between the containers to be connected, a locking member shiftably mounted in said abutment, said locking member including first and second coupling projections located on two opposed sides of the abutment and adapted to extend into oppositely opposed mounting holes in said corner fittings of said containers, means for shifting the locking member relative to the abutment in one direction in order to insert said first coupling projection into one of said opposed mounting holes and means for shifting the locking member relative to the abutment in another direction after said first coupling projection has been inserted into said one mounting hole, wherein the coupling piece further includes a securing means which is adapted to lock the abutment and prevent rotation or displacement of the abutment relative to the containers, wherein the securing means of the coupling piece includes a centering projection which prospects at least from one face of the abutment and which is adapted to at least partially engage the edge of the mounting hole of said corner fitting of one of the containers which is to be connected, and a pivotable locking lever which is adapted to positively engage the edge of the mounting hole of a corner fitting.

3. The combination of claim 1, wherein the locking lever of the coupling piece is adapted to be lockable in a position in which it secures the abutment relative to the corner fittings of the containers.

4. A coupling piece for connecting containers having elongated mounting holes on board of ships wherein the containers have elongated mounting holes with edges on opposite sides of said hole, said coupling piece including an abutment adapted to be located essentially between the containers to be connected and upper and lower coupling projections which are arranged on opposed sides of the abutment and which are connected integrally to the abutment and adapted to extend into the mounting holes of adjacent containers, wherein at least one coupling projection is provided with a first glide face adapted to shift said coupling piece in one direction when said coupling projection and said first glide face contact one edge of the elongated mounting hole and a second glide face for shifting said coupling piece in an opposite direction when said second glide face contacts an opposite edge of the elongated mounting hole after said first glide face has entered said elongated mounting hole, wherein one of said glide faces is curved in a concave manner.

5. A coupling piece and first and second corner fittings for connecting containers, said corner fittings having elongated mounting holes with edges on opposite sides of said holes, said coupling piece including an abutment adapted to be located essentially between the first and second corner fittings on the containers to be connected and upper and lower coupling projections which are arranged on opposed sides of the abutment and which are connected integrally to the abutment and adapted to extend into the mounting holes of adjacent corner fittings, wherein at least one coupling projection is provided with a first glide face adapted to shift said coupling piece in one direction when said coupling projection and said first glide face contact one edge of the elongated mounting hole of said first corner fitting and a second glide face for shifting said coupling piece in an opposite direction when said second glide face contacts an opposite edge of the elongated mounting hole of said first corner fitting after said first glide face has entered said elongated mounting hole.

6. The combination of claim 5, wherein at least one coupling projection of said coupling piece includes a middle piece which is adapted to project into the elongated mounting hole of one of said corner fittings, which middle piece is rotatable within the elongated mounting hole of said corner fitting and includes a lock for locking the middle piece within said corner fitting to prevent rotation.

7. The combination of claim 6, wherein the middle piece of said coupling piece includes a recess and a filling member, wherein the filling member fills the recess such that the middle piece does not rotate when positioned within the elongated mounting hole of said corner fitting of the respective container.

* * * * *